US008911141B2

(12) United States Patent
Cheio De Oliveira et al.

(10) Patent No.: US 8,911,141 B2
(45) Date of Patent: Dec. 16, 2014

(54) MIXING DEVICE HAVING RADIAL OPENINGS AND ROTOR SUPPORTED MIXING BLADES

(75) Inventors: Jose Cheio De Oliveira, Saint Hilaire de Loulay (FR); Henri Daheron, Bouffere (FR); Pascal Ricard, Treize Septiers (FR)

(73) Assignee: VMI (FR)

( * ) Notice: Subject to any disclaimer, the term of this patent is extended or adjusted under 35 U.S.C. 154(b) by 0 days.

(21) Appl. No.: 13/982,855

(22) PCT Filed: Dec. 12, 2011

(86) PCT No.: PCT/FR2011/052940

§ 371 (c)(1), (2), (4) Date: Jul. 31, 2013

(87) PCT Pub. No.: WO2012/104497

PCT Pub. Date: Aug. 9, 2012

(65) Prior Publication Data

US 2013/0315026 A1 Nov. 28, 2013

(30) Foreign Application Priority Data

Jan. 31, 2011 (FR) ..... 11 50704

(51) Int. Cl.

| | |
|---|---|
| ***B01F 5/12*** | (2006.01) |
| ***B01F 15/02*** | (2006.01) |
| ***B01F 3/12*** | (2006.01) |
| ***B01F 7/16*** | (2006.01) |

(52) U.S. Cl.

CPC ..... *B01F 15/0227* (2013.01); *B01F 3/1221* (2013.01); *B01F 7/162* (2013.01); *B01F 7/164* (2013.01); *B01F 15/0258* (2013.01); *B01F 2215/0031* (2013.01); *B01F 2215/0032* (2013.01)

USPC ..... 366/164.6; 366/264

(58) Field of Classification Search

CPC .. B01F 7/008; B01F 7/00808; B01F 7/00816; B01F 7/1625; B01F 7/163; B01F 7/1635; B01F 7/164; B01F 7/1645

USPC ..... 366/163.1, 164.1–164.6, 181.4, 264, 366/139, 182.4

See application file for complete search history.

(56) References Cited

U.S. PATENT DOCUMENTS

| | | | | |
|---|---|---|---|---|
| 1,496,641 | A * | 6/1924 | Hurrell | 241/146 |
| 7,178,977 | B2 * | 2/2007 | Colding-Kristensen et al. | 366/264 |

(Continued)

FOREIGN PATENT DOCUMENTS

| | | |
|---|---|---|
| DE | 8006977 U1 | 7/1980 |
| DE | 20221717 U1 | 5/2007 |

(Continued)

OTHER PUBLICATIONS

International Search Report issued Mar. 26, 2012 re: PCT/FR2011/052940; citing: FR 2 929 133 Al, DE 202 21 717 U1, GB 907 063 A, JP 62 275023 A and DE 80 06 977 U1.

*Primary Examiner* — Charles Cooley

(74) *Attorney, Agent, or Firm* — Cantor Colburn LLP

(57) ABSTRACT

A mixing device having at least one rotor supporting mixing blades that is also capable of being rotated. The device further includes an annular ring surrounding the rotor and having at least one axial opening and radial mixing openings associated with the mixing blades so as to allow the passage of the mixture therethrough. At least one particle-conveying line leads to the inside of said ring. The annular ring has a recirculation stage placed between the conveying line and the radial mixing openings and further includes at least two axially consecutive rows of radial openings.

9 Claims, 2 Drawing Sheets

(56) References Cited

U.S. PATENT DOCUMENTS

| | | | | |
|---|---|---|---|---|
| 7,261,545 | B2 * | 8/2007 | Yerian et al. | 425/257 |
| 2004/0190373 | A1 * | 9/2004 | Colding-Kristensen et al. | 366/306 |
| 2004/0223407 | A1 * | 11/2004 | Gassenschmidt | 366/295 |
| 2011/0026358 | A1 * | 2/2011 | Cheio De Oliveira et al. | 366/139 |
| 2013/0315026 | A1 * | 11/2013 | Cheio De Oliveira et al. | 366/134 |

FOREIGN PATENT DOCUMENTS

| | | | |
|---|---|---|---|
| EP | 801974 | A1 * | 10/1997 |
| FR | 2929133 | A1 | 10/2009 |
| GB | 907063 | A | 10/1962 |
| JP | 62275023 | A | 11/1987 |

* cited by examiner

MIXING DEVICE HAVING RADIAL OPENINGS AND ROTOR SUPPORTED MIXING BLADES

TECHNICAL FIELD

The present invention relates to a mixing device, a mixing assembly equipped with such a device, and a method for manufacturing a preparation.

The device as well as the mixing assembly are in particular designed for the manufacture of a preparation, and more particularly the dispersion of particles in a preparation.

BACKGROUND

In the prior art, it is known to produce preparations by mixing substances in a vat and introducing powdered particles into said vat so as to incorporate them into the mixture.

Such preparations are for example commonly manufactured for pharmaceutical, cosmetic, agri-food and other applications. For pharmaceutical or cosmetic applications in particular, the incorporated particles may make up the active ingredient of the composition and must then be incorporated into the mixture in very precise proportions. The final mixture must furthermore be as homogenous as possible.

In order to produce such preparations, mixing assemblies are known. According to the most widespread technology, these comprise a vat, wherein an under-pressure is maintained and which is designed to receive the mixture, a rotor including mixing blades and cooperating with motor means so as to be rotated, and a stator including an annular ring surrounding the rotor and having radial openings for the passage of the mixture projected radially by said rotor.

Two methods are commonly used to incorporate particles into the preparation.

According to a first method, the particles are introduced by suction into the vat, in which an under-pressure is maintained, by means of a conveying line emerging in the bottom of the vat, laterally with respect to the rotor-stator unit. The conveying line is equipped with a valve making it possible to command the introduction of particles into the vat. The particles to be incorporated into the mixture circulate in the vat approximately following a convection path of the mixture in the vat. However, in this case, the introduction flow rate of the powder is directly related to the vacuum level in the vat. Consequently, for a given valve, the vacuum must be increased to increase the flow rate of introduced particles. However, depending on the viscosity of the mixture in the vat, an excessively high vacuum level creates too fast a passage of the particles through the mixture and the aspirated particles become glued against the upper part of the vat; this generates cleaning and product loss problems. This is particularly significant when the injected product is the active ingredient of the final mixture, which may then be under-dosed.

According to a second method, the mixing assembly is equipped with an outside pipe allowing recirculation of the preparation. In this embodiment, the powdered particles are introduced into the vat by means of a conveying line emerging in the outer pipe forming a recirculation loop. However, this method poses cleaning problems for said outside pipe. Furthermore, the introduction flow rate of the powder is limited by the dimensions of the outer pipe and the circulation flow rate therein.

In order to offset these drawbacks, the applicant has developed a third method making it possible to effectively disperse particles in a mixture with a high flow rate and reducing product losses. This method is described in document FR 2,929,133.

According to this method, the particles are introduced by suction into the vat kept, in which an under-pressure is maintained, by means of a conveying line emerging in the vat at the rotor of the rotor-stator unit. The conveying line is equipped with a valve making it possible to command the introduction of particles into the vat. The particles to be incorporated into the mixture are thus introduced directly at the heart of the mixing and turbulence area and vigorously ejected with the mixture circulating in the vat. Such a system makes it possible to ensure effective, homogenous mixing with a high flow rate (reduced introduction time and mixing time).

It has, however, appeared that such a system could also have certain limitations. It may in particular be desirable to further improve the introduction of the powder and to avoid any plugging and wetting of the introduction valve.

BRIEF SUMMARY

The present invention aims to avoid these limitations, and to that end provides a mixing device comprising:

- at least one rotor supporting mixing blades and designed to cooperate with at least one motor means so as to be able to be rotated,
- an annular ring surrounding the rotor and forming the stator, said ring having at least one axial opening and radial mixing openings associated with the mixing blades for the passage of the mixture therethrough,
- at least one particle-conveying line conveying particles designed to be incorporated into said mixture and emerging inside said ring,
- characterized in that the annular ring has a recirculation stage positioned between the conveying line and the radial mixing openings, said recirculation stage comprising at least two axially consecutive rows of radial openings.

Thus, by providing a complementary recirculation stage formed in the ring, a slight additional under-pressure is created at the particle-conveying line, which facilitates the introduction and wetting of said particles and the non-wetting of said line.

Advantageously, the motor means comprise a motor block including said motor means and a drive shaft connecting the rotor to the motor means.

Preferably, the motor block supports at least one portion of the conveying line.

Advantageously, the motor block includes the rotor and the annular ring.

Preferably, the motor block comprises means for fastening to a mixing vat, said fastening means advantageously being pressure-tight.

Advantageously, the conveying line passes through said fastening means for fastening to the vat.

According to one particular embodiment, the motor block includes two coaxial rotors.

Preferably, the mixing blades are arranged to suction the mixture through the axial opening of the annular ring and project it radially through radial openings of the annular ring.

Advantageously, the conveying line emerges substantially at a radial end of the mixing blades.

According to one preferred embodiment, the radial openings of the rows of the recirculation stage are axially aligned.

Preferably, the radial openings of the rows of the recirculation stage have a length oriented radially along the periphery.

Advantageously, the length of the radial mixing openings is oriented axially. Still more advantageously, the radial mixing openings are oblique.

Preferably, the conveying line is equipped with at least one valve. It may in particular be a flap gate or a pneumatic valve. Also advantageously, the valve may be supported by the motor block.

The present invention also relates to a mixing assembly characterized in that it comprises a vat designed to receive the mixture and at least one mixing device according to the invention.

Advantageously, the mixing assembly comprises means for establishing an under-pressure inside the vat.

The present invention further relates to a method for manufacturing a preparation comprising at least one mixing step including a step for introducing particles into said mixture, characterized in that the introduction step is carried out using a mixing assembly according to the invention.

Advantageously, an under-pressure may be maintained in the vat so as to allow the introduction of the particles by suction.

Preferably, at least two non-miscible substances are mixed in order to manufacture an emulsion.

BRIEF DESCRIPTION OF THE DRAWINGS

The present invention will be better understood in light of the following detailed description, in reference to the appended drawings, in which.

DETAILED DESCRIPTION

Figure 1:
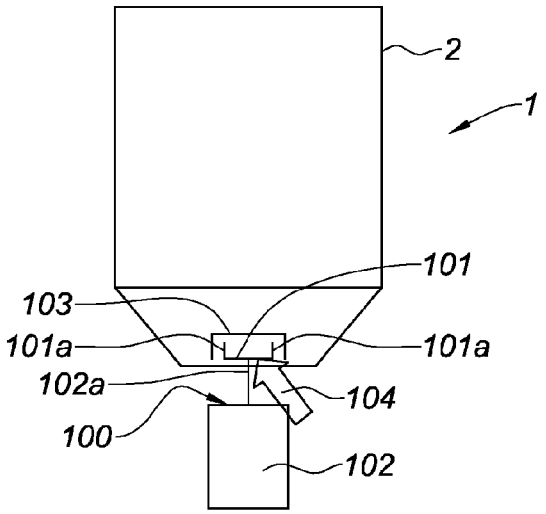
FIG. 1 is a diagrammatic diagram of the introduction principle according to the third method described above.

FIG. 1 shows a mixing assembly 1 according to the invention.

This mixing assembly 1 comprises a vat 2 having a bottom equipped with a mixing device 100 according to the invention operating according to the principle of the third method previously mentioned and described in document FR 2,929,133.

The vat 2 is of course equipped with intake and discharge means for fluids and the end mixture (not shown).

The mixing device 100 comprises a rotor 101 supporting mixing blades 101*a* and which can be rotated by a motor means 102.

The mixing device 100 also comprises an annular ring 103 surrounding the rotor 101 and forming a stator. The annular ring 103 has a central axial opening 103*a* and radial mixing openings 103*b* associated with the mixing blades 101*a*.

The radial mixing openings 103*b* are slits extending axially substantially parallel to each other and slightly oblique with respect to the axis of rotation of the rotor 101. The radial mixing openings 103*b* are separated by solid parts serving as impact surface for the projected particles.

According to the method described in document FR 2,929,133, the mixing device 100 is equipped with a conveying line 104 (arrow FIG. 1) emerging in the vat 2 at the rotor 101, inside said annular ring 103 of the mixing device 100.

The conveying line 104 is equipped with a valve 104*a* making it possible to command the introduction of particles into the vat 2.

More specifically, the mixing device 100 is made in the form of a motor block including the motor means 102 and a drive shaft 102*a* connecting the rotor 101 to the motor means 102.

The motor block bears at least part of the conveying line 104 as well as the rotor 101 and the annular ring 103.

This motor block is furthermore equipped with fastening means for fastening to the mixing vat 2, said fastening means assuming the form of a fastening disc 106 that is advantageously pressure-tight.

The conveying line 104 and the drive shaft 102*a* therefore pass through the fastening disc 106 to penetrate the inside of the vat 2.

More specifically, the conveying line 104 emerges substantially at a radial end of the mixing blades 101*a*.

According to the invention, the annular ring 103 has a recirculation stage 105 positioned in the conveying line 104 and the radial mixing openings 103*b*.

This recirculation stage 105 comprises at least two axially consecutive rows of radial recirculation openings 105*a* situated between the conveying line 104 and the radial mixing openings 103*b* associated with the rotor 101.

According to the preferred embodiment shown as an example, the radial openings 105*a* of the two rows of the recirculation stage 105 are axially aligned. Advantageously, the radial openings 105*a* have a large length extending radially over the periphery of the ring 103.

During operation, the mixture present in the vat 2 is aspirated through the central axial opening 103*a* and projected by the mixing blades 101*a* of the rotor 101 through the radial mixing openings 103*b* of the ring 103.

The rotor 101 also aspirates particles introduced into the vat 2 by the conveying line 104 and projects them with the mixture. The latter undergoes shearing in the radial projection direction. The interstice between the rotor 101 and the ring 103 is small enough to obtain the desired shearing stresses (arrows FIG. 2).

The complementary recirculation stage 105 of the ring 103 makes it possible to create a slight additional under-pressure at the particle-conveying line 104, which facilitates the introduction and wetting of said particles and the non-wetting of said line.

Figure 2:
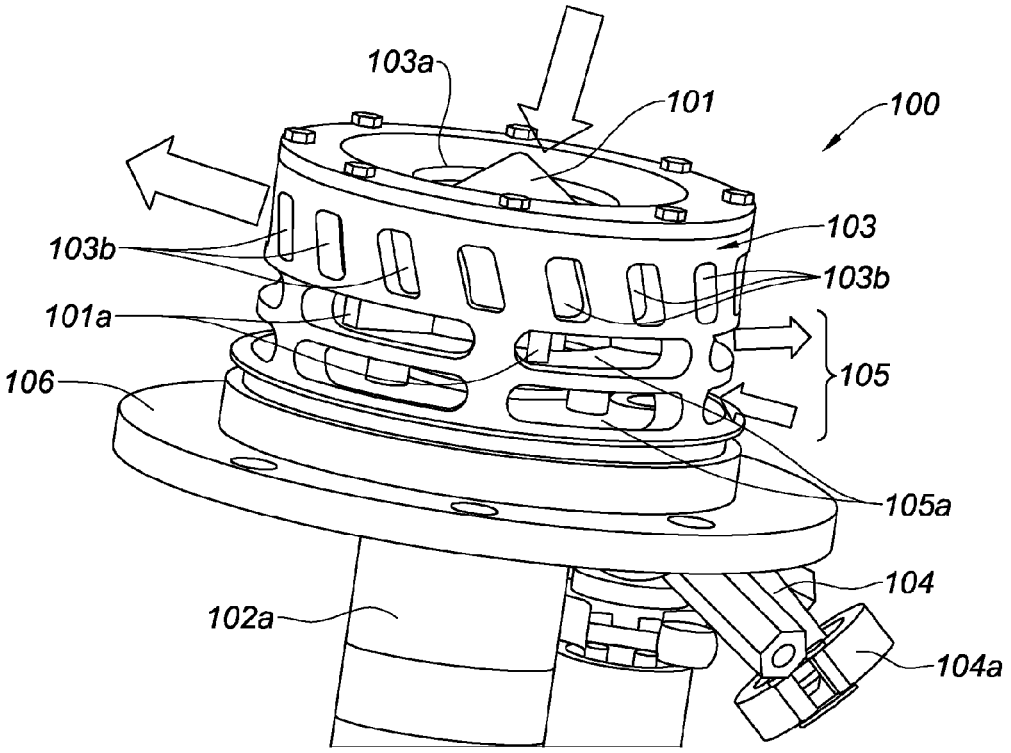
FIG. 2 is a partial enlarged illustration centered on the rotor-stator unit of a mixing device according to the invention.
Figure 3:
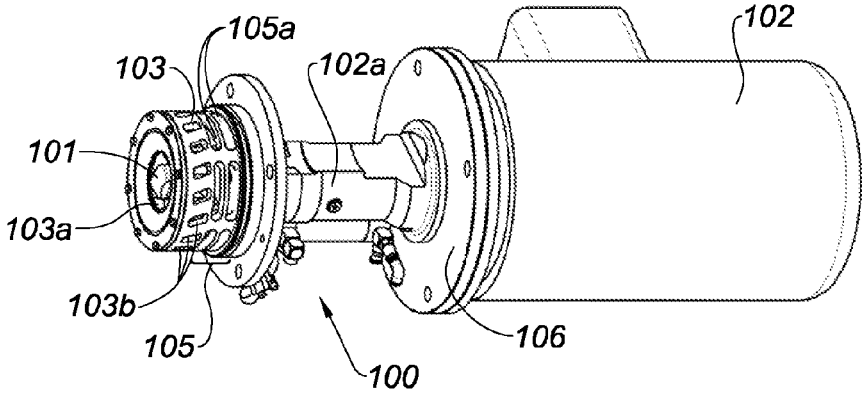
FIG. 3 is an overall view of the mixing device of FIG. 2.
Figure 4:
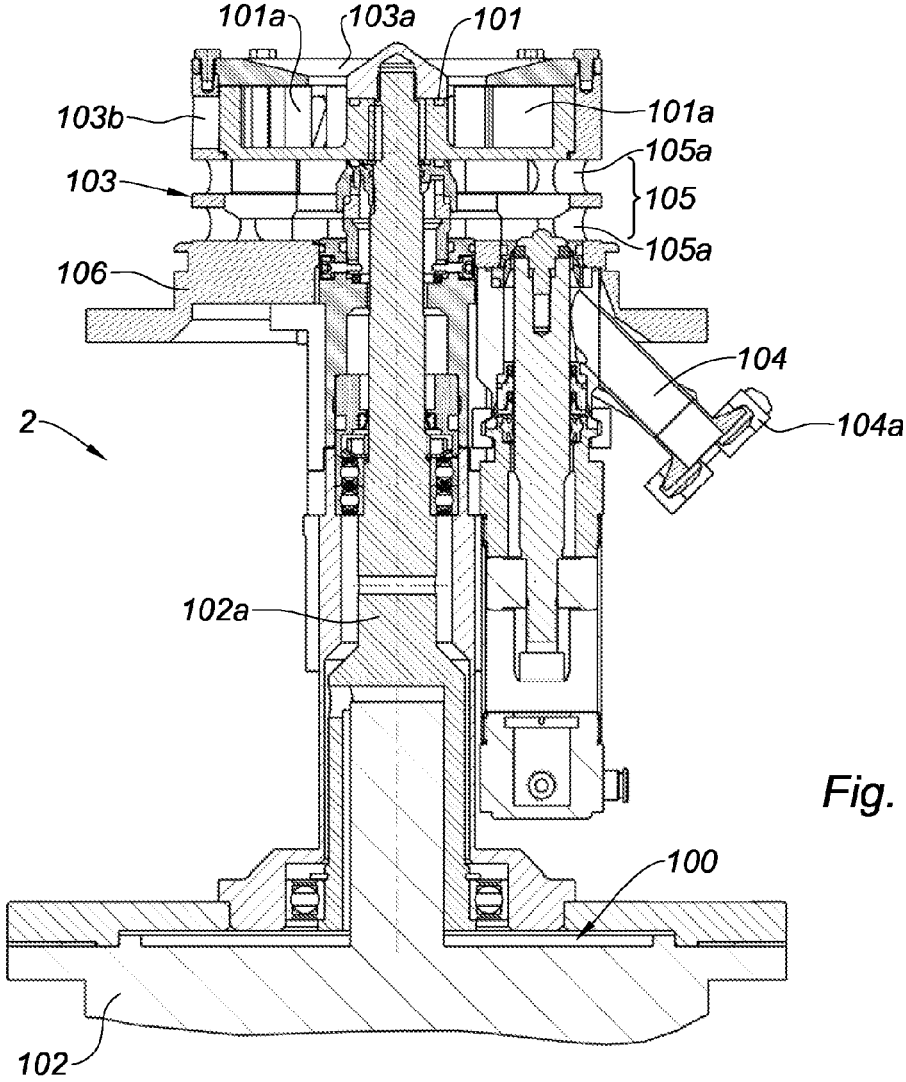
FIG. 4 is a diagrammatic transverse cross-sectional illustration of the mixing device of FIG. 2.

It follows that before being added to the mixture and projected through the radial mixing openings 103*b* of the ring 103, the particles first follow a recirculation loop formed by the recirculation stage 105 of the ring 103 (arrows FIG. 2).

More specifically, particles leave the ring 103 through the radial openings 105*a* of the row of the recirculation stage 105 closest to the rotor 101 and are re-aspirated in the ring 103 through the radial openings 105*a* of the row of the recirculation stage 105 closest to the conveying line 104.

It will be noted that advantageously, the mixing assembly 1 comprises means for establishing an under-pressure inside the vat 2.

The particles may therefore be aspirated in the vat 2 through the conveying line 104 without requiring injection by a pump if applicable.

The described device may in particular advantageously be used to manufacture a preparation comprising at least one mixing step including a step for introducing particles into said mixture. The introduction step will be carried out using a mixing assembly according to the invention. Preferably, at least two non-miscible substances are mixed in order to manufacture an emulsion.

Although the invention has been described with one particular example embodiment, it is of course in no way limited thereto and encompasses all technical equivalents of the described means as well as combinations thereof if they are within the scope of the invention.

The invention claimed is:

1. A mixing device comprising:

at least one rotor supporting mixing blades and designed to cooperate with at least one motor means so as to be able to be rotated, an annular ring surrounding the rotor and forming the stator, said ring having at least one axial opening and radial mixing openings associated with the mixing blades for the passage of the mixture therethrough, at least one particle-conveying line conveying particles designed to be incorporated into said mixture and emerging inside said ring, wherein the annular ring has a recirculation stage positioned between the conveying line and the radial mixing openings, said recirculation stage comprising at least two axially consecutive rows of radial openings.

2. The mixing device according to claim 1, wherein the mixing blades are arranged to suction the mixture through the axial opening of the annular ring and project it radially through the radial mixing openings of the annular ring.

3. The mixing device according to claim 1, wherein the conveying line emerges substantially at a radial end of the mixing blades.

4. The mixing device according to claim 1, wherein the radial openings of the rows of the recirculation stage are axially aligned.

5. The mixing device according to claim 1, wherein the radial openings of the rows of the recirculation stage have a length oriented radially along the periphery.

6. The mixing device according to claim 1, wherein the length of the radial mixing openings is oriented axially.

7. The mixing device according to claim 1, wherein the conveying line is equipped with at least one valve.

8. A mixing assembly, comprising a vat designed to receive a mixture and at least one mixing device according to claim 1.

9. A method for manufacturing a preparation having at least one mixing step, the method including the following steps:

providing a mixing assembly having a vat and at least one rotor supporting mixing blades configured to cooperate with at least one motor means, providing an annular ring surrounding the rotor and forming the stator, wherein the annular ring includes at least one axial opening and radial mixing openings associated with the mixing blades for the passage of the mixture therethrough, providing at least one particle-conveying line conveying particles configured to be incorporated into the mixture and emerging inside the ring, positioning a recirculation stage between the conveying line and the radial mixing openings, the recirculation stage having at least two axially consecutive rows of radial openings; and introducing particles into a mixture in the vat.

* * * * *